US008419508B2

(12) United States Patent
Cady et al.

(10) Patent No.: US 8,419,508 B2
(45) Date of Patent: Apr. 16, 2013

(54) METHODS OF FABRICATING A HONEYCOMB EXTRUSION DIE FROM A DIE BODY

(75) Inventors: Raymond Charles Cady, Horseheads, NY (US); Mihir Mahendra Shah, Elmira, NY (US); Aric Bruce Shorey, Painted Post, NY (US); Kevin Lee Wasson, Elmira, NY (US)

(73) Assignee: Corning Incorporated, Corning, NY (US)

( * ) Notice: Subject to any disclaimer, the term of this patent is extended or adjusted under 35 U.S.C. 154(b) by 323 days.

(21) Appl. No.: 12/789,896

(22) Filed: May 28, 2010

(65) Prior Publication Data

US 2011/0290078 A1 Dec. 1, 2011

(51) Int. Cl.
*B21K 5/20* (2006.01)

(52) U.S. Cl.
USPC ..... 451/48; 29/558; 700/172; 76/107.1

(58) Field of Classification Search ..... 228/161, 228/174; 250/559.19, 559.2, 559.24, 559.27; 264/177.12; 29/407.04, 557, 558; 324/658, 324/661, 662, 671; 356/237.1, 237.3–237.6, 356/630, 631, 635; 425/461–464; 451/10, 451/5, 21, 22, 45, 56, 6, 8; 702/170, 172; 72/324; 73/865.8, 104; 76/107.1; 83/51, 83/875, 876; *B21K 5/20*
See application file for complete search history.

(56) References Cited

U.S. PATENT DOCUMENTS

| | | | | |
|---|---|---|---|---|
| 2,846,773 | A * | 8/1958 | Carlson | 33/501.9 |
| 3,504,279 | A * | 3/1970 | Foster et al. | 324/662 |
| 3,606,666 | A * | 9/1971 | Briggs | 29/407.05 |
| 3,641,431 | A * | 2/1972 | Pigage et al. | 324/662 |
| 4,071,820 | A * | 1/1978 | Mushinsky | 324/671 |
| 4,236,355 | A * | 12/1980 | Hennenfent et al. | 451/342 |
| 4,787,362 | A * | 11/1988 | Boucher et al. | 125/15 |
| 4,798,469 | A * | 1/1989 | Burke | 356/609 |
| 4,929,256 | A * | 5/1990 | Shepherd | 51/293 |
| 5,224,272 | A * | 7/1993 | Toraason et al. | 33/504 |
| 5,313,742 | A * | 5/1994 | Corcoran et al. | 451/541 |
| 5,662,514 | A * | 9/1997 | Masseth et al. | 451/5 |
| 5,839,943 | A * | 11/1998 | Stadtfeld | 451/8 |
| 6,290,837 | B1 | 9/2001 | Iwata et al. | 205/665 |
| 6,462,811 | B1 * | 10/2002 | Turner et al. | 356/237.1 |
| 6,517,427 | B1 * | 2/2003 | Yoshikawa et al. | 451/547 |
| 6,732,621 | B2 * | 5/2004 | Iwata et al. | 83/51 |
| 6,800,018 | B2 * | 10/2004 | Tricard et al. | 451/28 |
| 2002/0186370 | A1 * | 12/2002 | Roesner et al. | 356/301 |
| 2008/0168866 | A1 * | 7/2008 | Baba | 76/107.1 |
| 2009/0185177 | A1 * | 7/2009 | Manfred | 356/237.2 |
| 2009/0244528 | A1 * | 10/2009 | Suzuki | 356/237.2 |

FOREIGN PATENT DOCUMENTS

JP 2005-246505 A 9/2005

* cited by examiner

*Primary Examiner* — Lee D Wilson
*Assistant Examiner* — Tyrone V Hall, Jr.
(74) *Attorney, Agent, or Firm* — Matthew B. McNutt

(57) ABSTRACT

A method for screening abrasive wheels for fabricating a honeycomb extrusion die from a die body, and methods for fabricating a honeycomb extrusion die using an abrasive wheel assembly. One method for fabricating a honeycomb extrusion die includes measuring at least one of runout and thickness of each of a plurality of abrasive blades while rotating the blades, selecting a subset of the plurality of blades that have a measured runout or a measured thickness within a predetermined range, and mounting the subset of blades spaced from one another and concentrically aligned along a rotation axis of the abrasive wheel assembly.

23 Claims, 5 Drawing Sheets

METHODS OF FABRICATING A HONEYCOMB EXTRUSION DIE FROM A DIE BODY

FIELD

The present disclosure relates generally to methods of fabricating a honeycomb extrusion die including discharge slots, and more particularly, to a process to produce the slots in the extrusion dies for making honeycomb products.

BACKGROUND

Methods of fabricating a honeycomb extrusion die from a die body or blank include electrical discharge machining and abrasive wheel slitting. Electrical discharge machining is known to provide an extrusion die having variable slot dimensions, and abrasive wheel slitting has been proposed as a method to fabricate an extrusion die having slot dimensions with reduced variability. Even with such advances in die manufacturing technology, there is a continued need for extrusion dies having slot dimensions with improved (i.e., reduced) variability, both within a single slot, and from slot to slot.

SUMMARY

In one aspect, a method is provided for fabricating a honeycomb extrusion die from a die body using an abrasive wheel assembly, the method comprising the steps of: measuring at least one of runout and thickness of each of a plurality of abrasive blades while rotating the blades; selecting a subset of the plurality of blades that have at least one of a measured runout or a measured thickness within a predetermined range; and mounting the subset of blades spaced from one another and concentrically aligned along a rotation axis of the abrasive wheel assembly.

In another aspect, a method is provided for fabricating a honeycomb extrusion die from a die body using an abrasive wheel assembly, the method comprising the steps of: mounting a plurality of blades spaced from one another and concentrically aligned along a rotation axis of the abrasive wheel assembly; measuring at least one of runout and thickness of each of the plurality of blades while rotating the abrasive wheel assembly about the rotation axis; removing blades having a measured runout or thickness exceeding a predetermined threshold from the abrasive wheel assembly; replacing removed blades with new blades; repeating the before mentioned steps until none of the blades on the abrasive wheel assembly exceed the predetermined threshold; and then grinding a plurality of parallel extrusion slots into the die body by rotating the abrasive wheel assembly about the rotation axis and moving the abrasive wheel assembly along a first directional axis while contacting the die body with the plurality of blades.

In another aspect, a method is provided for screening abrasive wheels for fabrication of a honeycomb extrusion die. In one embodiment, the method comprises: measuring at least one of runout and thickness of each of a plurality of abrasive blades while rotating the blades; and selecting a subset of the plurality of blades, wherein each of the selected blades has a measured thickness that is no greater than about +/−3% of a target blade width, and a measured runout less than about 10% of the target blade width.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

Figure 1:
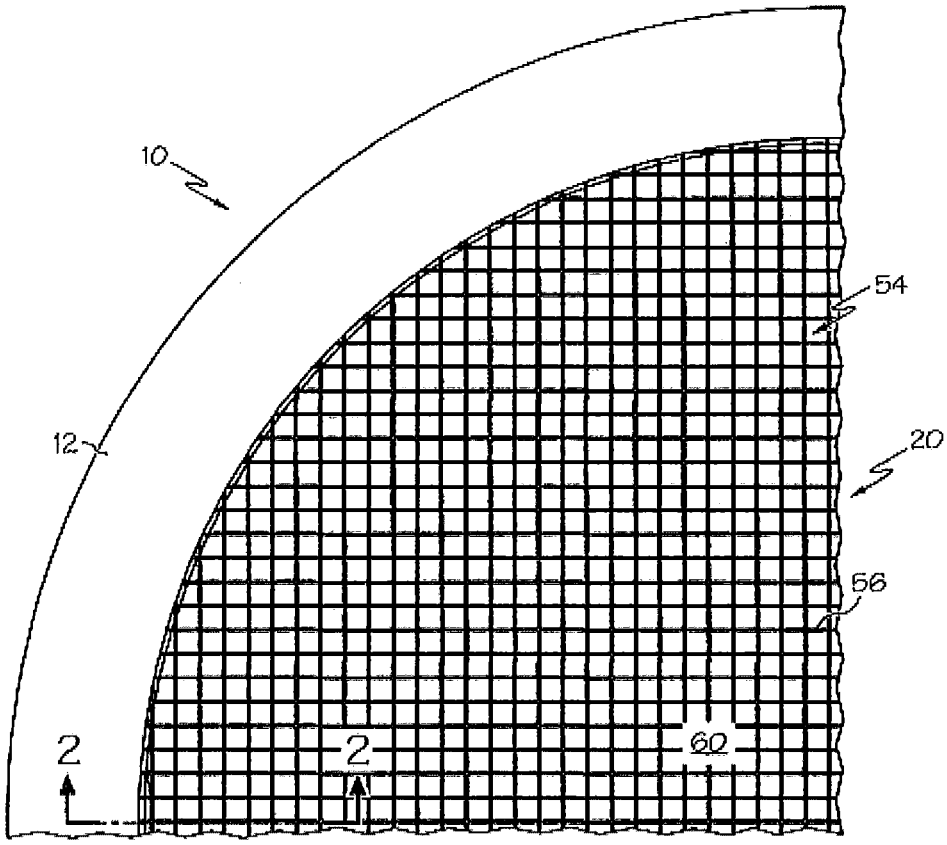
FIG. 1 is a partial plan view of an example honeycomb extrusion die apparatus.

The present invention will now be described more fully hereinafter with reference to the accompanying drawings in which example embodiments of the claimed invention are shown. Whenever possible, the same reference numerals are used throughout the drawings to refer to the same or like parts. However, the claimed invention may be embodied in many different forms and should not be construed as limited to the embodiments set forth herein. These example embodiments are provided so that this disclosure will be both thorough and complete, and will fully convey the scope of the claimed invention to those skilled in the art.

Figure 2:
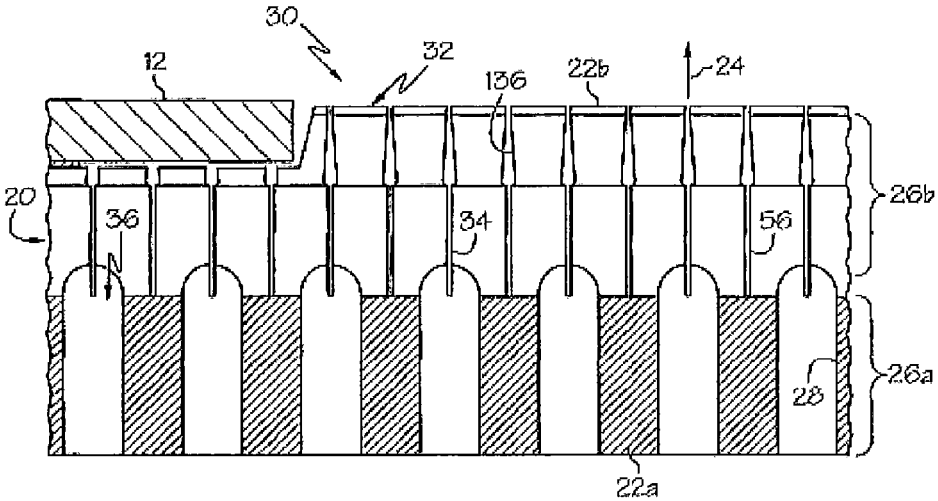
FIG. 2 is a partial sectional view of the honeycomb extrusion die apparatus along line 2-2 of FIG. 1.

An example honeycomb extrusion die 10 can comprise a die body 20 configured to be installed as part of an extrusion device (not shown). As shown in FIGS. 1 and 2, the honeycomb extrusion die can also comprise a mask member 12, and/or other components in addition to the die body 20. The honeycomb extrusion die 10 is configured to facilitate extrusion of plasticized ceramic-forming batch material to form a honeycomb body. For instance, honeycomb bodies can be used as a particulate filter for processing exhaust from a combustion engine. In some examples, the honeycomb bodies may be loaded with a catalyst to reduce nitrogen oxide compounds or other environmental pollutants.

Referring now to FIG. 1, a schematic illustration of a second quadrant of an example honeycomb extrusion die 10 is shown. Although not shown, the first quadrant can be a mirror image of the second quadrant about a vertical axis. Moreover, the third and fourth quadrants can be a mirror image of the first and second quadrants, respectively, about a horizontal axis. Thus, FIG. 1 can represent an example honeycomb extrusion die that has a circular discharge surface 60 configured to extrude cylindrical honeycomb bodies having a circular cylindrical form. The surface 60 of the honeycomb extrusion die 10 can have different shapes in other embodiments. For instance, the discharge surface can have a polygonal shape with three or more sides (e.g., triangular, rectangular, square, etc.) or other geometric shapes, such as elliptical or the like. The shape of the discharge surface can be selected depending on the desired cross-sectional shape of the honeycomb bodies extruded with the die body 20.

Referring now to FIG. 2, the die body 20 may include an inlet end 22*a* and a discharge end 22*b* opposite the inlet end 22*a* in an extrusion direction 24. The die body 20 may include an inlet region 26*a*, beginning at the inlet end 22*a*, that defines a plurality of feedholes 28 extending from the inlet end 22*a*. The plurality of feedholes 28 are configured to receive batch material from an extrusion device (not shown) such as a ram extruder or screw extruder. The die body 20 further includes a discharge region 26*b* terminating at the discharge end 22*b*. The discharge region 26*b* includes a plurality of die pins 30. Each die pin 30 includes an end face 32 positioned along the surface 60 (see FIG. 1) of the die body 20.

Each die pin 30 also includes side walls 34 defining a honeycomb pattern 54 (see FIG. 1) of extrusion slots 56 extending into the die body 20 from the surface 60. The extrusion slots 56 can connect with the feedholes 28 at feed hole and discharge slot intersections 36 at an interface within the die body 20 between the inlet region 26*a* and the discharge region 26*b*.

Figure 3:
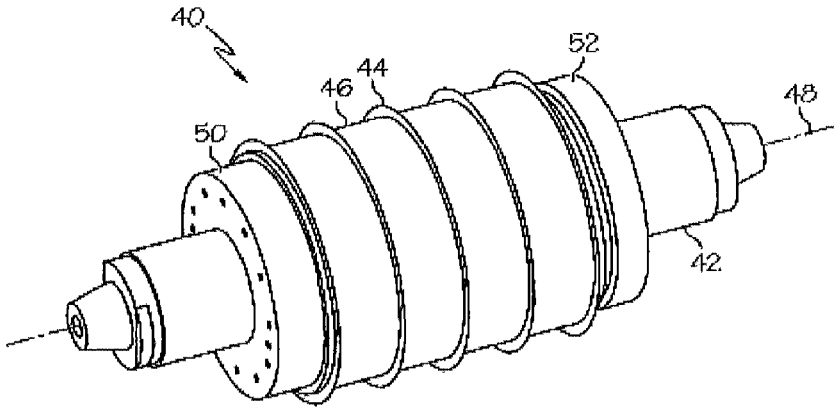
FIG. 3 is a perspective view of an example abrasive wheel assembly.

FIG. 3 illustrates a perspective view of an example abrasive wheel assembly 40 that may be used to machine a plurality of parallel extrusion slots 56 into the die body 20. The assembly 40 may be provided with various alternative structures and configurations in accordance with aspects of the claimed invention. As shown in the illustrative example, the assembly 40 can include at least one blade 44 configured to machine the extrusion slots into the die body 20. The illustrated example is shown to include a plurality of blades 44 (e.g., five blades) separated by spacers 46, although more or less than five blades may be provided in further examples. The number of blades 44 may be selected based on several factors. For example, reducing the number of blades may be desirable to reduce the power requirements for the motor (not shown) that drives the assembly 40 to spin around a rotation axis 48 of the assembly 40. Reducing the number of blades may be desirable to reduce blade to blade variability, and thereby reduce the variability between slots cut by different blades on the assembly 40. Increasing the number of blades may allow simultaneous machining of a larger subset of extrusion slots 56, thereby reducing the overall processing time necessary to produce the final honeycomb pattern of extrusion slots. In the illustrated example, five blades 44 may be provided to help balance the considerations of power requirements for the motor, blade to blade variability (and thus slot to slot variability), and processing time. In other embodiments, the desired balance of these factors may be achieved by using 2, 3, 4, 6, 7 8, or more blades 44.

The abrasive wheel assembly 40 can further include an axial member, such as the illustrated arbor 42, to allow the one or more blades 44 to be concentrically aligned along the rotation axis 48 of the assembly 40. The arbor, if provided, can include various features to cooperate with the one or more blades 44. For example, as shown, the arbor 42 can comprise a circular cylindrical shaft with the illustrated tapered ends. In alternative examples, the arbor may comprise a cylinder with a polygonal cross section (e.g., triangular, rectangular, etc.) or other shapes. Providing a polygonal cross section may be desirable to help nonrotatably position the one or more blades 44 relative to the arbor 42. The arbor may further include mounting features to help position the one or more blades 44 relative to the arbor 42. For example, as shown, one end of the arbor 42 may have a raised rim 50 while an opposed end of the arbor 42 may be threaded (not shown). The threaded end of the arbor 42 can be configured to receive the illustrated compression nut 52.

A slitting machine (not shown) may be provided to receive the abrasive wheel assembly 40. The slitting machine may be configured to receive the arbor 42 and rotate the assembly 40 about the rotational axis 48 during the machining process. In one example, the arbor 42 is placed on a 4-axis milling machine and may be spun up to 20,000 rpm although the arbor 42 may be rotated at different speeds in further examples. As will be described below, the blades 44 may be rotated at a sufficient speed to provide effective machining of the extrusion slots 56. Optionally, cutting fluid, coolant, or the like may be distributed to the blades for cooling and/or removing debris during the machining process. If dimensions (e.g., spacing, width or depth) of the slots 56 are to be altered for any reason, the compression nut 52 may be removed from the arbor 42. Blades 44 and/or spacers 46 having different dimensions may then be placed on the arbor 42.

As shown, the plurality of blades 44 may be spaced evenly along the rotation axis 48 to allow a plurality of parallel evenly spaced slots to be machined into the die body 20. In one example, one or more spacers 46 may be provided between corresponding pairs of blades 44. The width of each spacer 46 depends on a target distance between each adjacent extrusion slot, also referred to as the pitch. For instance, for a die body with a larger distance between each adjacent slot, each spacer 46 may have a corresponding width, such that each adjacent blade 44 is spaced wide enough to form the desired die pin size. In further examples, the blades 44 may be spaced at a multiple of the spacing between adjacent extrusion slots 56 of the final honeycomb pattern 54 of extrusion slots. For example, a first pass may machine every other extrusion slot while a second pass may machine extrusion slots between the previously machined extrusion slots.

As shown in FIG. 3, the spacers 46 are substantially circular in shape, however other shapes and sizes are contemplated. For instance, the spacers 46 may be polygonal in shape, such as rectangular, square, etc. or other geometric shapes, such as elliptical, etc. Moreover, the spacers 46 may have varying sizes. In the shown example, the spacers 46 have a slightly smaller diameter than the blades 44. The spacers 46 may have a sufficiently small diameter, such that the blades 44 can form the desired slot depth for slots 56 without the spacers 46 contacting the die body 20. The spacers 46 may be made of a number of materials, such as ceramic, metal, etc. In addition, the spacers 46 may be removable, allowing a user to insert a differently sized spacer 46 and adjust the distance between the blades 44 (and the distance between slots 56 formed thereby).

It will be appreciated that the blades 44 may comprise a wide range of materials and sizes, depending on factors including the die body material, the desired width and/or depth of the slots, etc. For instance, the blades 44 may be made of fine abrasive particles (such as ceramic or diamond particles) uniformly dispersed in a metal matrix material that acts as the binder and gives the blade its solid structure. In other examples, the blade 44 may be formed of any materials suitable for grinding the material of the die body. Additionally, the desired thickness of the blades 44 will depend on the target size of the extrusion slots 56. In some examples, the desired thickness of the blades 44 may range from 0.002"-0.030". That is, different blade sizes and shapes may be selected to produce slots having a desired width and depth. For instance, the desired thickness of each blade 44 may be selected to be slightly less than the target width of each extrusion slot 56. In one example, if the target slot width is 0.0048", a corresponding blade thickness for forming the slot may be 0.0045".

Ideally and in theory, the blades 44 mounted on the assembly 40 are identical to each other in size and shape, such that the slots 56 formed in the surface 60 of the die body 20 may also be nearly identical by having a substantially constant width and depth in the surface 60. However, in fact, each blade 44 may have a thickness that varies from one location on the blade to another location on the same blade, and further the thickness of one blade may vary from the thickness of other blades on the assembly 40. In addition, blades 44 may have varying degrees of "runout" or error motion on their side faces. Runout can be produced by geometric errors in the blades 44 themselves, such as by the two faces of a blade not being perfectly parallel to each other. Runout can also be caused by imperfect spacers 46 (e.g., having non-parallel sides) and arbor assembly errors (e.g., debris between the blade 44 and spacer 46) that cause a blade to be positioned in a non-perpendicular orientation with respect to the rotation axis 48.

Variations in blade thickness and/or runout may lead to unwanted variations in slot thickness across the face of a die. Variations in slot thickness may in turn cause flow variations in the material being extruded through the die, and result in an unacceptable honeycomb body. Therefore, it is desired to measure the thickness and/or runout of each blade 44 when mounted in the abrasive wheel assembly 40 and running, prior to grinding slots 56. The measured variations in thickness and/or runout may then be used to predict slot width variation before the slots 56 are cut. This provides an opportunity to change one or more blades 44 prior to grinding slots 56 if the predicted slot width variation is greater than desired. In one example, blades 44 may be selected that are matched to within predetermined tolerances in thickness and/or runout. Alternatively, the measurement of blade thickness and/or runout may be used to identify problems with the abrasive wheel assembly 40 itself, and the assembly 40 may be reassembled to a better tolerance. In this manner, it is possible to avoid slots 56 with unacceptable variations or tolerances that may cause a die to be deemed unacceptable.

In one aspect, at least one of the thickness and runout of an individual blade 44 are measured using one or more non-contact displacement measurement probes or sensors (hereinafter "probes") positioned adjacent one or both sides of the blade. Suitable non-contact measurement probes may be, for example, capacitance based, impedance based, laser based, or optically based, as are known in the art. The particular non-contact based measurement technique may be selected depending upon factors including the material of the blade and required measurement accuracy. For example, a capacitance based measurement technique may be best suited for measurement of a blade formed of metal or having a metal matrix material binding together abrasive particles, because the metal provides electrical conduction and enables a capacitance probe to function with the blade as a target object.

Figure 4:
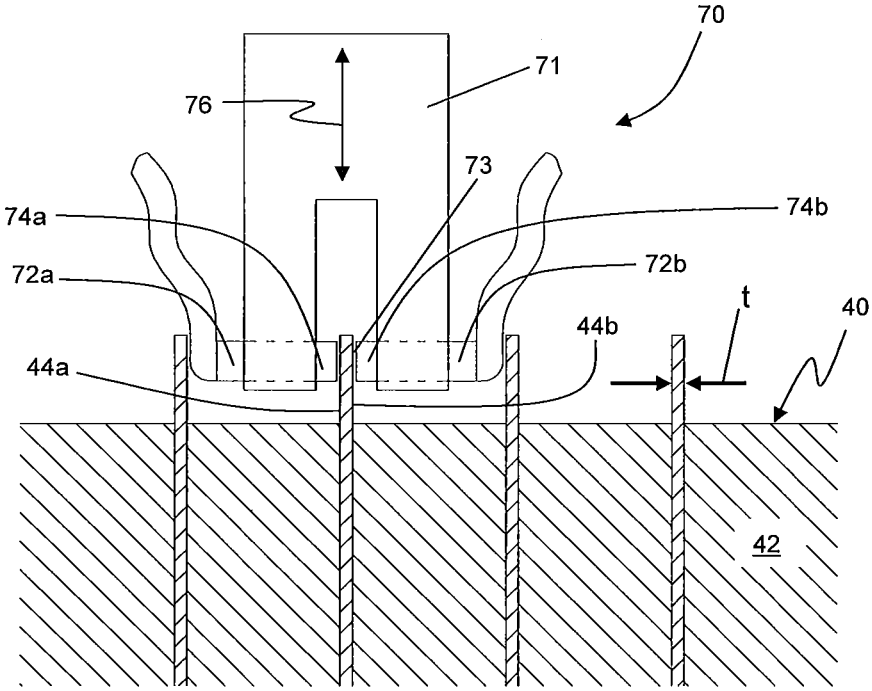
FIG. 4 is an illustration of an example apparatus for measuring runout and thickness of a blade on an abrasive wheel assembly.

In one embodiment, as illustrated in FIG. 4, a probe assembly 70 includes a probe holder 71 securing non-contact probes 72*a*, 72*b* (collectively probes 72). For calibration of the probes 72, a reference gage (not shown) of known thickness may be placed between the probes 72*a*, 72*b* and the baseline output of the two probes recorded. The end 74*a*, 74*b* of each probe 72 is positioned within a close distance to opposite side faces 44*a*, 44*b*, respectively, of one of the blades 44 on abrasive wheel assembly 40. A gap 73 is provided between the ends 74*a*, 74*b* of each probe and the opposing faces 44*a*, 44*b*, respectively, of the blade. The nominal gap used depends upon the probe type and its operating characteristics, but may be, for example, about 0.005 inches.

It will be recognized that, depending upon the distance between the blades 44 and/or the distance that blades 44 extend radially from arbor 42, probe assembly 70 may be differently configured from the illustration of FIG. 4. For example, as shown in FIG. 5, probe holder 71 may be configured to position probes 72 at an angle with respect to the blade 44, and/or probes 72 may be differently configured such as by use of different sensing tips.

After probes 72 are properly positioned with respect to blade 44, the abrasive wheel assembly 40 and blades 44 thereon are rotated about the rotation axis 48. In one embodiment, the blade 44 is rotated at about the same rate of speed that is used to cut slots 56. As blade 44 rotates, probes 72 sense any change in the gaps 73 and provide output signals that are indicative of the changes in the gaps 73. For example, capacitance sensors provide an output voltage that is proportional to the gap 73 between the probe 72 and the side of the blade 44. The changes in the gaps 73 indicate the displacement (i.e., runout) of each blade face 44*a*, 44*b* as a function of rotational position. In one embodiment, measurements are made at high sampling frequency and the data is stored (such as on a personal computer) for future analysis and use, as will be described in further detail below. This process is repeated for each blade 44 mounted to the abrasive wheel assembly 40. The measurements can also be repeated between successive cutting passes to determine blade wear and changes in blade runout before further slots are cut. Usefully, the rotational speed of the blade 44 can be varied and the runout can also be detected as a function of rotational speed. Since the probes 72 are measuring the runout of the blade relative to the probe assembly 70, any vibration in the structure supporting assembly 40 and/or in the components of assembly 40 will contribute to the measured runout of the blade, and preferred or optimal rotational speeds to minimize runout caused by system harmonics can be determined.

Figure 5:
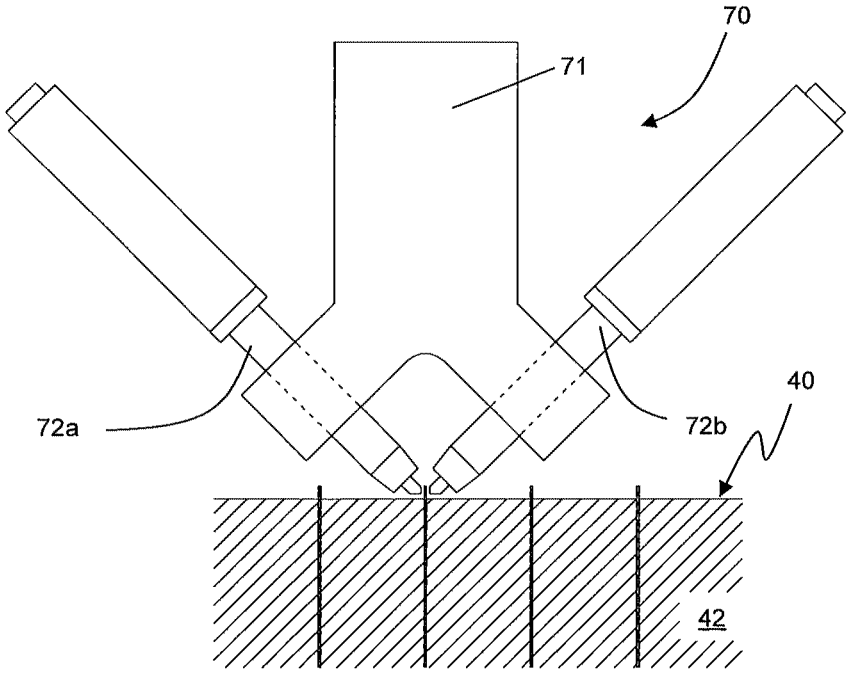
FIG. 5 is an illustration of another example apparatus for measuring runout and thickness of a blade on an abrasive wheel assembly

Although the embodiments of FIGS. 4 and 5 illustrate the use of two non-contact probes 72*a*, 72*b* positioned on opposite sides of blade 44, in other embodiments, runout may be measured using a single contact probe positioned on one side of blade 44. In such embodiments, probe assembly 70 may be configured similarly to that described with respect to FIGS. 4 and 5, but with one of the probes, such as probe 72*b*, eliminated from the assembly. Such single probe embodiments may be of particular use in situations where the thickness variation of blades 44 is already known to be within acceptable tolerances. In such situations, it is only necessary to measure runout of a blade from a single side of the blade.

In other embodiments, probe assembly 70 may be configured to move the one or more probes 72 radially along blade 44 (as indicated by arrow 76 in FIG. 4), such that the runout and/or thickness of the blade may be measured at multiple radial locations (or continuously along the radius), and thus any radial variation of the runout and/or thickness of the blade 44 may be determined. Such radial measurements may be particularly useful in determining or controlling the depth variability in addition to the width variability of a slot ground by the blade 44.

Figure 6A:
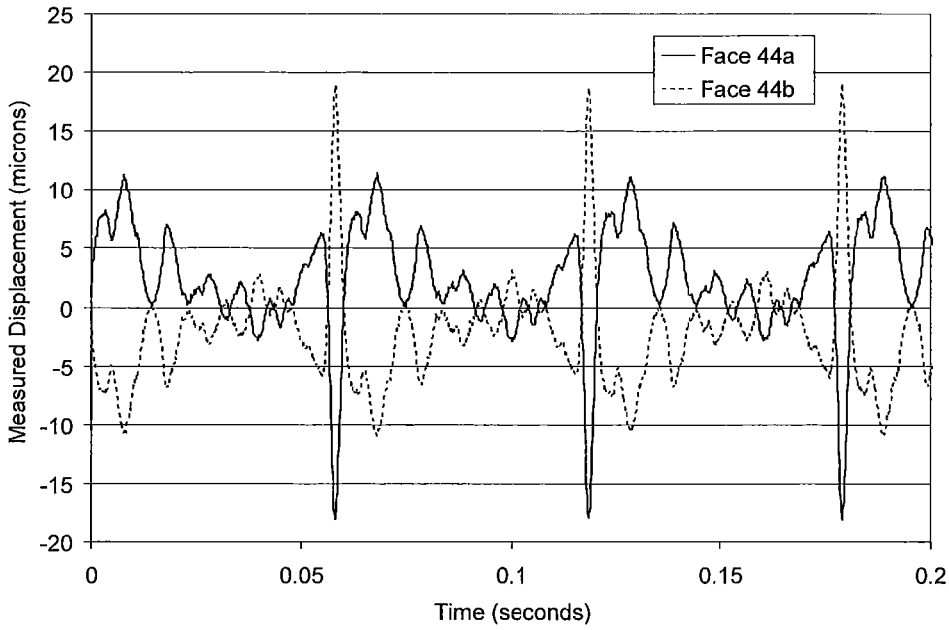
FIG. 6A is a plot showing measured displacement of an abrasive wheel in an abrasive wheel assembly.
Figure 6B:
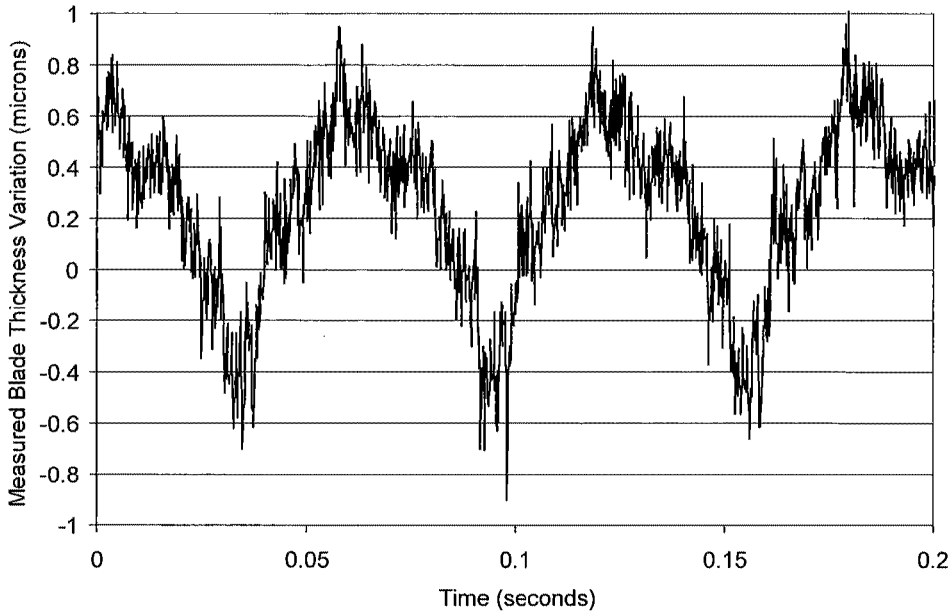
FIG. 6B is a plot showing blade thickness variation based on the measured displacement of the abrasive wheel in FIG. 6A.

FIG. 6A shows an example plot of displacement (i.e., runout) data for a single blade 44 collected as describe above, in which the rotating speed was 1,000 rpm and the period of one revolution was 0.06 seconds (60 milliseconds). Data for three revolutions is shown. As can be seen in FIG. 6A, the measured displacements of blade faces 44*a*, 44*b* substantially mirror each other (i.e., the blade 44 has some amount of "wobble"). The spike in the measured displacement may be caused, for example, by mechanical damage to the blade, or a warp in the blade. FIG. 6B illustrates blade thickness variation found by taking the data shown in FIG. 6A and adding the two values for measured displacement of blade faces 44*a*, 44*b*. The summation of output signals from the two probes 72 can be compared to the baseline output to determine the thickness t of the measured blade 44. The blade thickness and/or runout measurements may then be correlated with the expected slot width and slot width variability that will be cut by that particular blade, before any cuts are made.

Variations in thickness and/or runout of blades 44 on an abrasive wheel assembly ("blade to blade variability") may lead to unwanted variations in slot thickness across the face of a die ("slot to slot variability"). Slot to slot variability may in turn cause flow variations in the material being extruded through the die, and result in an unacceptable honeycomb body. Accordingly, after thickness and/or runout measurements of blades 44 have been obtained as described above, the thickness and/or runout measurements may be used to select or match blades for fabricating a honeycomb extrusion die 10 from a die body 20.

In one aspect, after obtaining thickness and/or runout measurements for a plurality of individual blades 44, a subset of those blades may be selected for use together on an abrasive wheel assembly 40 based on one or more criteria, including but not limited to: width of the individual blades (within a predetermined tolerance); maximum blade to blade width difference (within a predetermined tolerance, which in one embodiment may be a smaller tolerance than the tolerance for individual blades); and runout of individual blades (within a predetermined tolerance). In one embodiment, the plurality of blades is sorted using the listed criteria in the order provided (i.e., individual blade width, blade to blade width, and runout). In another embodiment, the plurality of blades is sorted using the listed criteria in a different order (e.g., runout, blade width, blade to blade width). In yet another embodiment, the plurality of blades is sorted using less than all of the listed criteria, together with additional selection criteria. In yet another embodiment, the plurality of blades is sorted using all of the listed criteria, together with additional selection criteria.

In one embodiment, the subset of blades selected each have a blade width no greater than about +/−3% of a target blade width. In another embodiment, the subset of blades selected each have a blade width no greater than about +/−2% of a target blade width. In yet another embodiment, the subset of blades selected each have a blade width no greater than about +/−1% of a target blade width.

In one embodiment, in addition to falling within the individual blade width tolerances described above, the subset of blades selected have a maximum blade to blade width difference no greater than about +/−2% of a target blade width. In another embodiment, the subset of blades selected have a maximum blade to blade width difference no greater than about +/−1% of a target blade width. In yet another embodiment, the subset of blades selected have a maximum blade to blade width difference no greater than about +/−0.5% of a target blade width.

In one embodiment, runout of individual blades is no greater than about 10% of a target blade width. In another embodiment, runout of individual blades is no greater than about 7% of a target blade width. In yet another embodiment, runout of individual blades is no greater than about 3% of a target blade width.

Figure 7A:
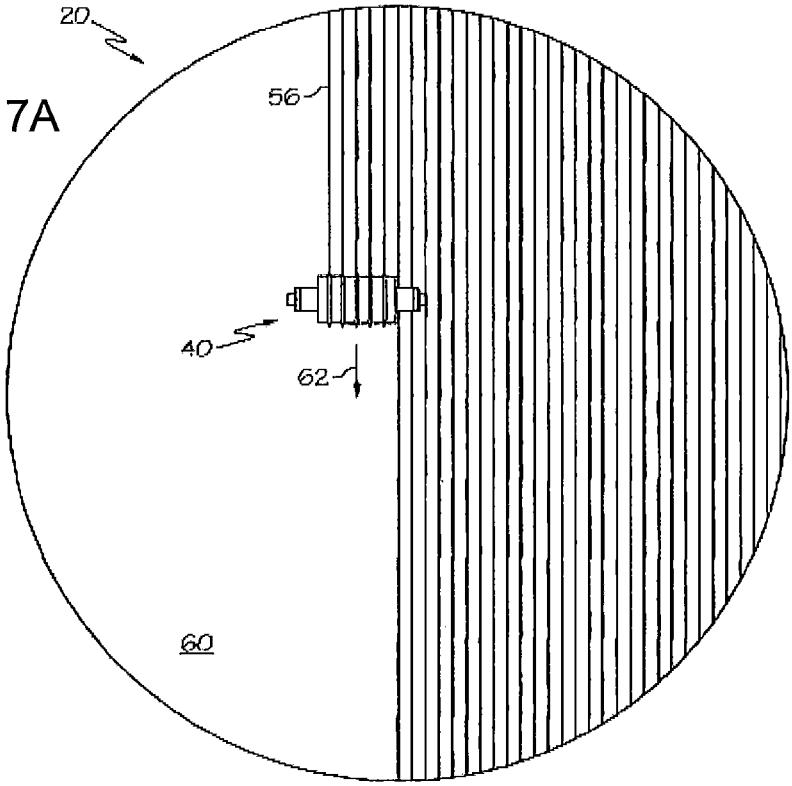
FIG. 7A is an example of a abrasive wheel assembly simultaneously machining a plurality of a first set of parallel extrusion slots into a die body.

Referring now to FIG. 7A, an illustration of the extrusion slots 56 being machined into the die body 20 is shown. The abrasive wheel assembly 40 may be spun about the rotation axis 48 while contacting the surface 60. In one example, the assembly 40 may start from an edge of the die body 20 and move along a first directional axis 62 while remaining in contact with the surface. Although not shown, the edges of the die body 20 may be chamfered to facilitate entry of the blades 44 through the edge of the die body 20. In another example, however, the assembly 40 may begin from within a central portion the surface 60 away from an edge of the die body 20. As the assembly 40 moves along the first directional axis 62, one or more extrusion slots 56 are machined into the die body 20 by the blades 44. For instance, in the schematically illustrated example, the assembly 40 has five blades 44. As such, the blades 44 simultaneously machines up to five parallel extrusion slots 56 into the surface 60 of the die body 20. The number of blades 44 may be varied, however, including providing as few as a single blade on the arbor 42 or more. With a single blade, the assembly 40 may machine a single slot into the surface 60 of the die body.

The first set of parallel extrusion slots may include extrusion slots 56 formed on the surface 60 of the die body 20 by moving the assembly 40 along one or more paths along the first directional axis 62. The paths taken by the assembly 40 may be changed, however. In one example, the first set of parallel extrusion slots may be formed by running the assembly 40 along the first directional axis 62 one or more times. The assembly 40 may have a sufficient number of blades such that a single path along the first directional axis 62 forms the extrusion slots 56 that comprise the first set of parallel extrusion slots.

The first set of parallel extrusion slots 56 may also be machined by successively passing the assembly 40 along the first directional axis 62 a plurality of times along a plurality of paths. For instance, in one example, the assembly 40 may make a path along the first directional axis 62 and form the extrusion slots 56. The assembly 40 may then retrace the path. Each path may provide the extrusion slot with an incremental increased depth, thereby providing the overall desired depth of the extrusion slot from a series of overlapped machining paths. The path may be completely retraced, or, in the alternative, may be partially retraced. Partial retracing or spaced apart paths may be provided to incrementally increase the width to provide the overall desired width of the extrusion slot from a series of machining paths.

Figure 7B:
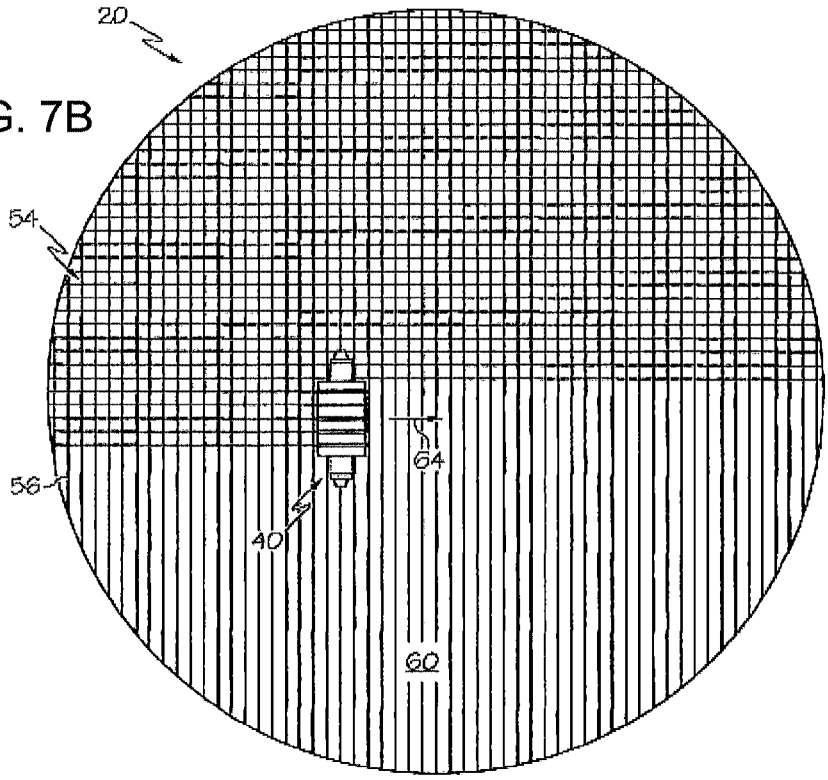
FIG. 7B is an example of the abrasive wheel assembly simultaneously machining a plurality of a second set of parallel extrusion slots into the die body of FIG. 7A.

In addition or alternatively, the first set of parallel extrusion slots may be produced by machining a first subset of extrusion slots and then subsequently machining a second subset of extrusion slots while not machining a plurality of the first subset of extrusion slots. In this example, the assembly 40 may make a pass along a first path to machine the first subset of extrusion slots. The assembly 40 may subsequently make a second pass along a second path spaced from the first path to machine the second subset of extrusion slots. Therefore, the first set of extrusion slots may include a combination of subsets of extrusion slots successively machined into the die body. Successive machining of each subsequent subset may occur adjacent to the previously machined subset although subsets may be randomly or selectively machined at alternative locations of the die body. As shown, the second subset of extrusion slots is machined while not machining any of the first subset of extrusion slots. In this example, the first set of parallel extrusion slots may be achieved with a reduced number of paths. Alternatively, when machining the second subset of extrusion slots, at least one of the blades may pass through extrusion slots of the first subset to further machine the slot or simply pass through the slot without machining Referring now to FIG. 7B, an illustration of the extrusion slots 56 being machined into the die body 20 along a second directional axis 64 is shown. In the shown example, the second directional axis 64 intersects the first directional axis 62 substantially perpendicularly to form a honeycomb pattern 54 of extrusion slots 56. In other examples, however, the second directional axis 64 may be positioned at a different angle with respect to the first directional axis 62, such as by forming an angle of more or less than a 90° with respect to the first directional axis 62. As such, die pins having various polygonal configurations may be provided to define a honeycomb network of various cell configurations. The method of forming the slots along the second directional axis 64 may be similar or identical to the method of forming the slots along the first directional axis 62 described above.

Fabricating a honeycomb extrusion die by machining the extrusion slots with an abrasive wheel assembly as described herein can reduce the variability of the extrusion slot dimensions (e.g., width), and a target slot dimension can be achieved. The machining of the slots 56 with the assembly 40 having blades 44 of reduced variability reduces the slot dimension variability from slot to slot.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A method of fabricating a honeycomb extrusion die from a die body using an abrasive wheel assembly, the method comprising the steps of:

measuring at least one of runout and thickness of each of a plurality of abrasive blades while rotating the blades;

selecting a subset of the plurality of blades that have at least one of a measured runout or a measured thickness within a predetermined range from a target blade width; and mounting the subset of blades spaced from one another and concentrically aligned along a rotation axis of the abrasive wheel assembly.

2. The method of claim 1, further comprising:

remeasuring at least one of runout and thickness of each of the subset of blades after mounting on the abrasive wheel assembly.

3. The method of claim 1, further comprising:

grinding a plurality of parallel extrusion slots into the die body by rotating the abrasive wheel assembly about the rotation axis and moving the assembly along a first directional axis while contacting the die body with the blades mounted on the assembly.

4. The method of claim 3, further comprising:

remeasuring at least one of runout and thickness of each of the subset of blades after grinding at least a subset of the extrusion slots.

5. The method of claim 1, wherein measuring at least one of runout and thickness comprising measuring with at least one non-contact probe selected from capacitance-based probes, impedance-based probes, laser-based probes, and optically-based probes.

6. The method of claim 1, wherein measuring at least one of runout and thickness of each of a plurality of abrasive blades comprises measuring runout on at least one side of the blades.

7. The method of claim 1, wherein measuring at least one of runout and thickness of each of a plurality of blades while rotating the blades comprises measuring each of the plurality of blades while mounted on the abrasive wheel assembly and rotating about the rotation axis of the assembly.

8. The method of claim 1, wherein measuring at least one of runout and thickness of each of a plurality of abrasive blades while rotating the blades comprises measuring at least one of runout and thickness as a function of rotational position.

9. The method of claim 1, wherein a rotation rate of the abrasive wheel assembly while measuring approximates a rotation rate of the abrasive wheel assembly while grinding.

10. The method of claim 1, wherein selecting a subset of the plurality of blades comprises selecting a subset of the plurality of blades that have a measured thickness that is no greater than about +/−3% of the target blade width.

11. The method of claim 1, wherein selecting a subset of the plurality of blades comprises selecting a subset of blades that have a maximum blade to blade width difference no greater than about +/−2% of the target blade width.

12. The method of claim 1, wherein selecting a subset of the plurality of blades comprises selecting a subset of the plurality of blades that have a measured runout less than about 10% of the target blade width.

13. The method of claim 1, wherein selecting a subset of the plurality of blades comprises selecting a subset of the plurality of blades that have a measured thickness that is no greater than about +/−3% of the target blade width, a maximum blade to blade width difference no greater than about +/−2% of the target blade width, and a measured runout less than about 10% of the target blade width.

14. The method of claim 13, wherein selecting a subset of the plurality of blades comprises selecting a subset of the plurality of blades that have a measured thickness that is no greater than about +/−2% of the target blade width, a maximum blade to blade width difference no greater than about +/−1% of the target blade width, and a measured runout less than about 7% of the target blade width.

15. A method of fabricating a honeycomb extrusion die from a die body using an abrasive wheel assembly, the method comprising the steps of:

a) mounting a plurality of blades spaced from one another and concentrically aligned along a rotation axis of the abrasive wheel assembly;

b) measuring at least one of runout and thickness of each of the plurality of blades while rotating the abrasive wheel assembly about the rotation axis;

c) removing blades having a measured runout or thickness exceeding a predetermined threshold from the abrasive wheel assembly;

d) replacing removed blades with new blades;

e) repeating steps a) through d) until none of the blades on the abrasive wheel assembly exceed the predetermined threshold; and f) grinding a plurality of parallel extrusion slots into the die body by rotating the abrasive wheel assembly about the rotation axis and moving the abrasive wheel assembly along a first directional axis while contacting the die body with the plurality of blades.

16. The method of claim 15, wherein removing blades having a measured runout exceeding a predetermined threshold comprises removing blades having a measured runout exceeding 10% of a target blade width.

17. The method of claim 15, wherein removing blades having a measured thickness exceeding a predetermined threshold comprises removing blades having a measured thickness that is +/−2% of a target blade width.

18. A method for screening abrasive wheels for fabrication of a honeycomb extrusion die, the method comprising:

measuring at least one of runout and thickness of each of a plurality of abrasive blades while rotating the blades; and selecting a subset of the plurality of blades, wherein each of the selected blades has a measured thickness that is no greater than about +/−3% of a target blade width, and a measured runout less than about 10% of the target blade width.

19. The method of claim 18, wherein the selected blades have a maximum blade to blade width difference no greater than about +/−2% of the target blade width.

20. The method of claim 18, wherein the selected blades have a maximum blade to blade width difference no greater than about +/−1% of the target blade width.

21. The method of claim 18, wherein each of the selected blades has a measured thickness that is no greater than about +/−2% of the target blade width.

22. The method of claim 18, wherein each of the selected blades has a measured runout less than about 7% of the target blade width.

23. The method of claim 18, wherein measuring at least one of runout and thickness of each of a plurality of abrasive blades comprises measuring using a non-contact probe selected from capacitance-based probes, impedance-based probes, laser-based probes, and optically-based probes.

* * * * *